US009004640B2

(12) United States Patent
Ishikawa et al.

(10) Patent No.: US 9,004,640 B2
(45) Date of Patent: Apr. 14, 2015

(54) PRINTING APPARATUS

(71) Applicant: Canon Kabushiki Kaisha, Tokyo (JP)

(72) Inventors: Tetsuya Ishikawa, Yokohama (JP); Atsushi Saito, Yokohama (JP); Shinya Asano, Tokyo (JP); Takatoshi Nakano, Yokohama (JP); Yutaka Kano, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/159,787

(22) Filed: Jan. 21, 2014

(65) Prior Publication Data

US 2014/0204144 A1 Jul. 24, 2014

(30) Foreign Application Priority Data

Jan. 24, 2013 (JP) ..... 2013-011166

(51) Int. Cl.
*B41J 29/393* (2006.01)
*B41J 3/60* (2006.01)
*B41J 11/00* (2006.01)

(52) U.S. Cl.
CPC ..... *B41J 3/60* (2013.01); *B41J 11/0095* (2013.01)

(58) Field of Classification Search
CPC ..... B41J 11/0095
See application file for complete search history.

(56) References Cited

U.S. PATENT DOCUMENTS

| | | | | |
|---|---|---|---|---|
| 5,131,770 | A * | 7/1992 | Kanemitsu | 400/568 |
| 5,209,589 | A * | 5/1993 | Bliss | 400/568 |
| 6,169,560 | B1 * | 1/2001 | Yoshida et al. | 347/217 |
| 6,639,238 | B2 * | 10/2003 | Kuo et al. | 250/551 |
| 7,192,207 | B2 | 3/2007 | Ohashi et al. | |
| 8,317,193 | B2 * | 11/2012 | Yano | 271/258.01 |
| 8,833,753 | B2 * | 9/2014 | Araishi | 271/10.02 |
| 2007/0075484 | A1 * | 4/2007 | Terada | 271/258.01 |
| 2014/0043394 | A1 | 2/2014 | Ishikawa et al. | |

FOREIGN PATENT DOCUMENTS

JP 2005-74746 A 3/2005

* cited by examiner

*Primary Examiner* — Julian Huffman
(74) *Attorney, Agent, or Firm* — Fitzpatrick, Cella, Harper & Scinto

(57) ABSTRACT

A printing apparatus, in which a time required for printing is shortened, includes a first printing unit that performs printing on a first surface of a sheet by an ink jet system, and a second printing unit that performs printing on a second surface of the sheet by the ink jet system, the second printing unit being disposed on a downstream side of the first printing unit. Moreover, the printing apparatus includes a sheet discharge sensor that detects the sheet to be discharged from the second printing unit. The sheet discharge sensor includes an arm having a rotating member supported thereon, the rotating member being brought into contact with the sheet being conveyed while being rotated.

10 Claims, 10 Drawing Sheets

PRINTING APPARATUS

BACKGROUND OF THE INVENTION

1. Field of the Invention

The present invention relates to a printing apparatus that prints an image on a sheet in an ink jet system.

2. Description of the Related Art

Japanese Patent Laid-Open No. 2005-74746 discloses an ink jet printing apparatus capable of ejecting ink from a print head to perform printing on both surfaces of a sheet. This apparatus is configured in such a manner as to enable printing on both surfaces, that is, the obverse and reverse of a sheet by a single printing unit. The sheet having an image printed on the obverse thereof in the printing unit is turned upside down on a reversing path, and then, is subjected to printing on its reverse in the printing unit again. Moreover, there is provided a sensor for detecting the passage of the sheet on a sheet conveyance path. Therefore, an arm of the sensor is brought into contact with the sheet when a sheet tip passes the sensor so that the sensor is turned ON, and thus, the sensor can recognize the passage of the sheet.

In order to increase the total throughput of double-sided printing, a sheet needs to be conveyed at a higher speed. However, as disclosed in Japanese Patent Laid-Open No. 2005-74746, an apparatus for performing double-sided printing by the single printing unit on the reversing path is configured to have a complicated reversing path. As a consequence, a jam (i.e., a paper jam) is liable to occur during sheet conveyance in such an apparatus, and therefore, it is difficult to increase a sheet conveyance speed. An increase in sheet conveyance speed also signifies that there is not much time required for drying ink. If the arm of the sensor is brought into contact with a printed image while the sheet is moved when the ink applied onto the sheet is not dried yet, a smudged trace remains on a final image. That is to say, the fear of a problem of a so-called smear is increased.

SUMMARY OF THE INVENTION

An object of the present invention is to provide a printing apparatus capable of printing images of a high quality on both surfaces of a sheet at a higher speed. Other objects of the present invention will be obvious from embodiments described below.

According to the present invention, a printing apparatus comprises a first printing unit configured to perform printing on a first surface of a sheet by an ink jet system; a second printing unit configured to perform printing on a second surface of the sheet by the ink jet system, the second printing unit being disposed on a downstream side of the first printing unit; and a detecting unit configured to detect the sheet to be discharged through the second printing unit, wherein the detecting unit includes an arm having a rotating member supported thereon, the rotating member being brought into contact with the sheet being conveyed while being rotated.

According to the present invention, a printing apparatus comprises an applying unit configured to apply an application liquid onto a sheet; a printing unit configured to perform printing on the sheet, onto which the application liquid is applied, by an ink jet system, the printing unit being disposed on a downstream side of the applying unit; and a detecting unit configured to detect the sheet, onto which the application liquid is applied, wherein the detecting unit includes an arm having a rotating member supported thereon, the rotating member being brought into contact with a surface, onto which the application liquid is applied, of the sheet being conveyed while being rotated.

The present invention of one aspect achieves the printing apparatus capable of printing the images of a high quality on both surfaces of the sheet at a higher speed.

Further features of the present invention will become apparent from the following description of exemplary embodiments (with reference to the attached drawings).

DESCRIPTION OF THE EMBODIMENTS

A description will be given below of a printing apparatus according to embodiments of the present invention. Although the embodiments described below exemplify apparatuses provided with full line type print heads covering the entire region of a sheet in a width direction, the present invention is not limited to these. The present invention is applicable to a printing apparatus of a so-called serial scan type, in which movement of a carriage mounting a print head thereon in a main scan direction and conveyance of a sheet in a sub scan direction are alternately performed, thus printing an image.

First Embodiment

Figure 1:
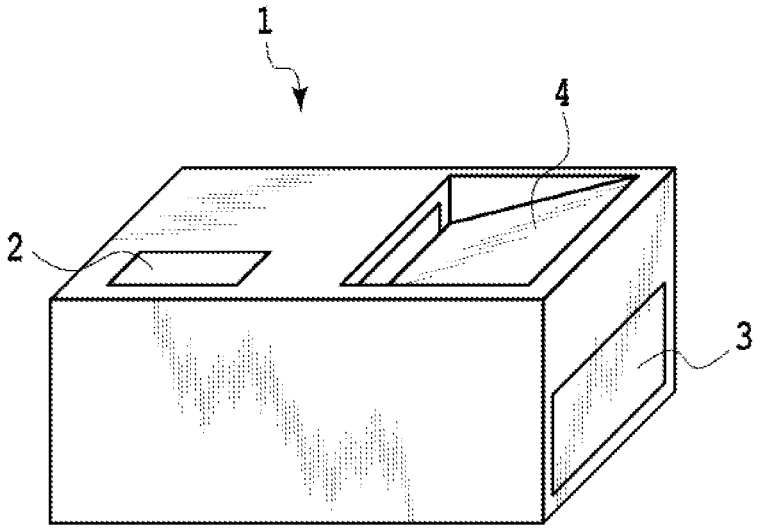
FIG. 1 is a perspective view schematically showing an ink jet printing apparatus according to a first embodiment of the present invention.

FIG. 1 is a perspective view showing the outside appearance of a printing apparatus 1 serving as an ink jet printing apparatus which performs printing in an ink jet system according to the present embodiment. The printing apparatus 1 uses a full line type print head. The printing apparatus 1 can perform double-sided printing, in which both of an obverse (i.e., a first surface) and a reverse (i.e., a second surface) of a sheet P are printed. The main body of the printing apparatus 1 includes a console panel 2. Moreover, the printing apparatus 1 includes a detachable sheet supply cassette (i.e., a supply unit) 3, which can contain a plurality of sheets (i.e., print mediums) therein. A sheet discharge tray (i.e., a discharge unit) 4 is formed at the printing apparatus 1. A printed sheet is discharged onto the sheet discharge tray 4, and thus, the sheet having a print image formed thereon can be taken out. The printing apparatus 1 includes a conveyance mechanism such as a conveyance roller for conveying the sheet P along a conveyance path.

Figure 2:
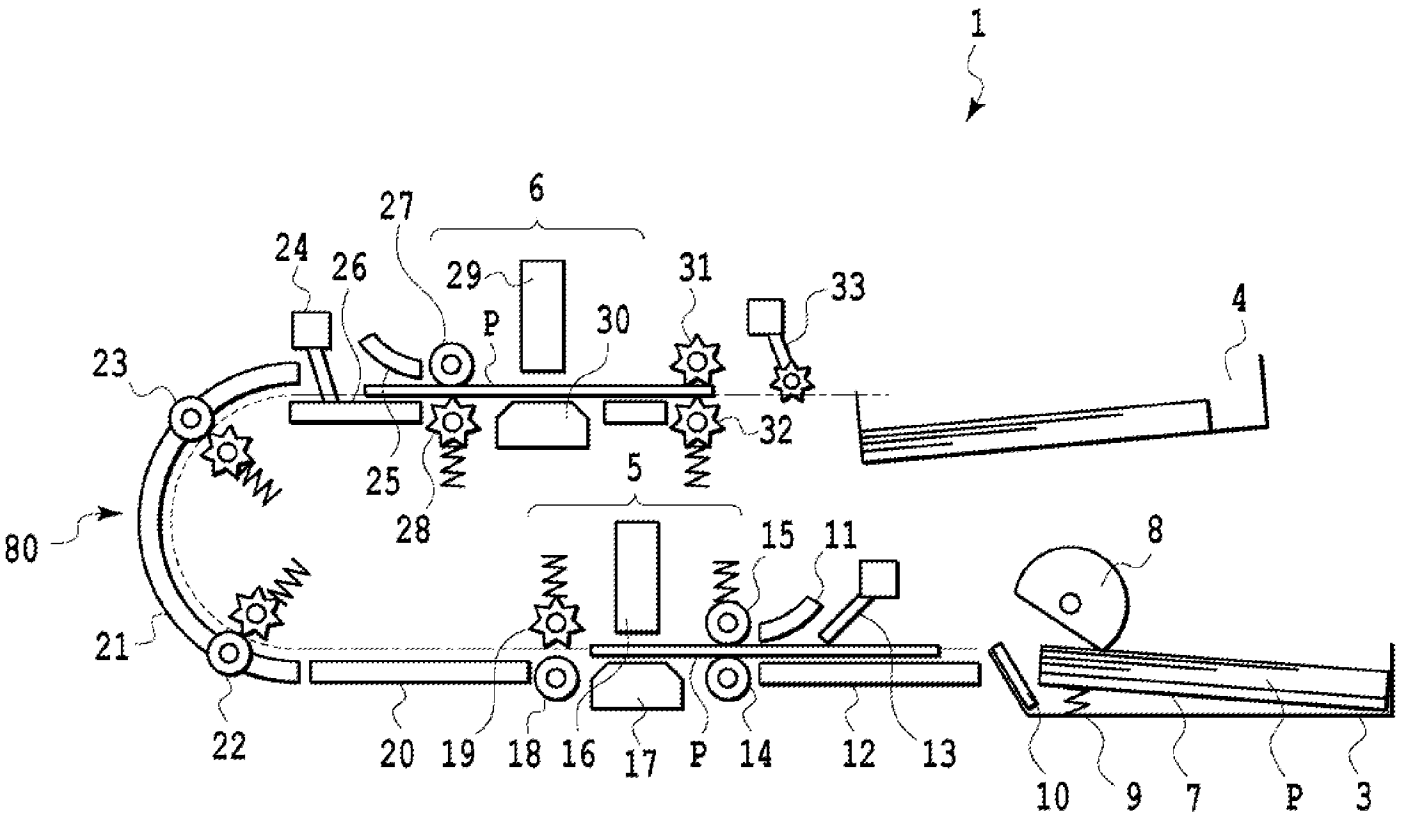
FIG. 2 is a cross-sectional view schematically showing a sheet conveyance path.

FIG. 2 is a schematically cross-sectional view showing a sheet conveying mechanism and a printing mechanism inside of the printing apparatus 1. In the printing apparatus 1 are provided, in order from the upstream side in a conveyance direction, the sheet supply cassette 3, a first printing unit 5, a U-turn path 80, a second printing unit 6, and the sheet discharge unit 4.

The sheet supply cassette 3 includes a pressure plate 7 for stacking the sheets P serving as print sheets thereon. The sheets P are stacked on the pressure plate 7. Cut sheets which are cut in a predetermined length in the conveyance direction are used as the sheets P. A pressure plate spring 9 is fixed to the pressure plate 7, which is configured in such a manner as to be freely pivoted on a pivotal axis. The pressure plate 7 is disposed in such a manner as to be urged by the pressure plate spring 9 in a direction in which it abuts against a sheet supply roller 8.

The sheet supply roller 8 is disposed at a position corresponding to the pressure plate 7 in such a manner as to be brought into free contact with the sheet P stacked on the pressure plate 7. When the sheet supply roller 8 is rotatably driven in a state in which the sheet supply roller 8 is brought into contact with the sheet P, the sheet P in abutment against the sheet supply roller 8 out of the sheets P stacked on the pressure plate 7 is pushed out forward in the conveyance direction. In this manner, the printing apparatus 1 starts a sheet supply operation.

At a position facing the sheet supply roller 8 on the pressure plate 7 is disposed a friction pad, not shown, having a large friction coefficient such as artificial leather for preventing any multi-feed of the sheets P. A separating member 10 made of a material such as artificial leather having a large friction coefficient or a resin part or the like having a knurl shape for separating the stacked sheets P one by one is provided at an abutment portion against the tip of the sheet P in the conveyance direction in the sheet supply cassette 3. The abutment and separation of the pressure plate 7 against and from the sheet supply roller 8 are switched by a release cam, not shown.

An upper guide 11 and a lower guide 12 are disposed on a downstream side in the conveyance direction of the sheet supply cassette 3. At a position corresponding to the lower guide 12 is disposed a first sheet sensor 13 capable of detecting the sheet passing on the lower guide 12.

The first sheet sensor 13 is configured in such a manner as to include a transparent type photointerrupter and a turnable detecting arm integral with a light shielding flag. A contact portion for detecting the existence of the sheet P based on a contact with the sheet P is formed at a tip of the detecting arm in the first sheet sensor 13 toward a sheet conveyance path. When the first sheet sensor 13 detects the existence of the sheet P based on the contact of the contact portion consisting of a rod-like member with the sheet P, the light shielding flag and the detecting arm are displaced, and then, a light receiving element can come to receive light emitted from a light emitting element in the photointerrupter. In this manner, the existence of the sheet P at the detection position by the first sheet sensor 13 is detected. Here, the contact portion of the first sheet sensor 13 in contact with the sheet P has no rotating member, described later, but it consists of a conventional rod-like member.

On the downstream side of the upper guide 11 and the lower guide 12 is disposed the first printing unit 5. The first printing unit 5 includes a conveyance roller 14, a pinch roller 15, a first print head 16, a platen 17, a sheet discharge roller 18, and a conveyance pulley 19. On the downstream side of the upper guide 11 and the lower guide 12 in the conveyance direction are arranged the conveyance roller 14 and the pinch roller 15. The pinch roller 15 is fixed in a state in which it is urged toward the conveyance roller 14. In other words, the pinch roller 15 is urged toward the conveyance roller 14 via a spring. As a consequence, the conveyance roller 14 is rotatably driven in a state in which the sheet P is pinched between the conveyance roller 14 and the pinch roller 15, so that the sheet P is conveyed along the conveyance path.

On the downstream side of the conveyance roller 14 and the pinch roller 15 in the conveyance direction is arranged the first print head 16. The first print head 16 can eject ink droplets toward the obverse of the sheet P, thereby performing printing. The first print head 16 is an ink jet head of a full line type having ink nozzles formed within a range covering the width of the sheet having a maximum size to be used so as to enable printing at a high speed.

Figure 3:
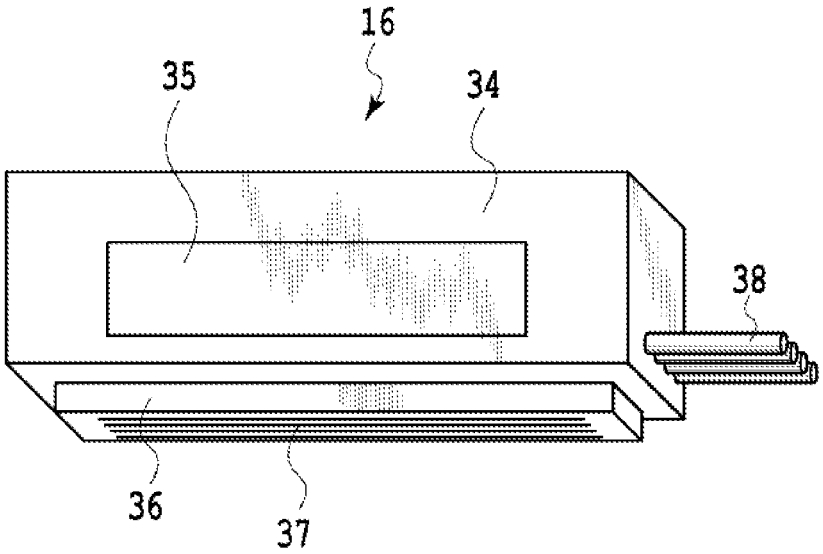
FIG. 3 is a perspective view showing a print head.

FIG. 3 is a perspective view showing the first print head 16. The first print head 16 is formed by fixing a chip plate 36 to a case 34 serving as a casing. The case includes an electric connector 35, which sends or receives information to or from the printing apparatus body 1. The chip plate 36 is made of a heat radiating material such as alumina, incorporates a heater or the like therein, and has ink paths formed therein. In this manner, the heater serving as a heat generating element (i.e., an electrothermal transducing element) is housed inside of each of the ink paths formed in the chip plate 36. Incidentally, the ink jet system is not limited to a system using the heat generating element but may be a system using a piezoelectric element, an MEMS element, an electrostatic element, or the like. At a surface facing the sheet in the chip plate 36 is formed an ejection port array 37 capable of ejecting the ink droplets. Since the first print head 16 is a print head of a full line type, the ejection port array 37 is formed in such a manner as to extend in a direction crossing (i.e., perpendicular to) the conveyance direction of the sheet P. Four ejection port arrays 37 are formed in the present embodiment, to thus print four kinds of ink in total, that is, C (cyan), M (magenta), Y (yellow), and BK (black). Ink supply tubes 38 and an ink supply system, not shown, constituted of a pump or the like supply the ink to the first print head 16.

The platen 17 is located at a position corresponding to the first print head 16. The platen 17 can mount the sheet P thereon. Printing can be performed by the print head 16 in a state in which the sheet P is mounted on the platen 17.

On the downstream side of the first print head and the platen 17 in the conveyance direction are disposed the sheet discharge roller 18 and the conveyance pulley 19. The conveyance pulley 19 is urged toward the sheet discharge roller 18. Specifically, the conveyance pulley 19 is urged toward the sheet discharge roller 18 via a spring. Consequently, the conveyance roller is rotatably driven in a state in which the sheet P is nipped between the sheet discharge roller 18 and the conveyance pulley 19, so that the sheet P is conveyed in the conveyance direction. The conveyance pulley 19 is a pulley having teeth formed at the periphery thereof, and therefore, has a small contact area with the sheet, thereby suppressing a smear caused by the contact.

On the downstream side of sheet discharge roller 18 and the conveyance pulley 19 in the conveyance direction is formed the U-turn path 80. On the U-turn path 80 are disposed a sheet guide 20, a U-turn guide 21, and U-turn conveyance roller pairs 22 and 23. On the downstream side of sheet discharge roller 18 and the conveyance pulley 19 is formed the sheet guide 20. The sheet P is conveyed onto the downstream side on the conveyance path under the guidance of the sheet guide 20. The sheet P having passed the sheet guide 20 is conveyed on the U-turn guide 21. The U-turn guide 21 is curved into a U shape, thereby changing the orientation of the sheet to be conveyed along the conveyance path on the U-turn guide 21. Moreover, the U-turn guide 21 changes the orientation of the conveyance path, thus turning the sheet P upside down.

Both of conveyance rollers on a drive side of the U-turn conveyance roller pairs 22 and 23 are urged toward the U-turn guide 21. The conveyance rollers on the drive side are formed in such a manner as to be able to nip the sheet P being conveyed on the U-turn guide 21 under the pressure against the surface of the U-turn guide 21. Both of the U-turn conveyance roller pairs 22 and 23 have pulleys on a side in contact with the surface of the sheet that has been printed in the first printing unit 5. Since the conveyance roller on the drive side is a pulley having teeth formed at the periphery thereof, a contact area with the sheet is small, thereby suppressing occurrence of a smear.

On the downstream side of the U-turn guide 21 are disposed an upper guide 25 and a lower guide 26. Moreover, at a position corresponding to the lower guide 26 is located a second sheet sensor 24 capable of detecting the sheet P being conveyed above the lower guide 26. Also in the second sheet sensor 24, a contact portion that is brought into contact with the sheet P is not provided with a rotating member, as described later, but consists of a conventional rod-like member, like the first sheet sensor 13.

On the downstream side of the upper guide 25 and the lower guide 26 is formed the second printing unit 6. The second printing unit 6 is provided with a conveyance roller 27, a pinch roller 28, a second print head 29, and a platen 30. On the downstream side of the upper guide 25 and the lower guide 26 are arranged the conveyance roller 27 and the pinch roller 28.

The pinch roller 28 is urged toward the conveyance roller 27. The pinch roller 28 is urged by a spring. The conveyance roller 27 is rotatably driven in a state in which the sheet P is nipped between the pinch roller 28 and the conveyance roller 27, so that the sheet P is conveyed in the conveyance direction. On the downstream side of the conveyance roller 27 and the pinch roller 28 are disposed the second print head (i.e., the second printing unit) 29 and the platen 30. The pinch roller 28 is a pulley having teeth formed at the periphery thereof, and therefore, the area of contact with the sheet is small, thereby suppressing occurrence of a smear.

The second print head 29 can eject ink droplets toward the reverse of the sheet P so as to perform printing. The second print head 29 also is a full-line type ink jet head having a structure similar to that of the first print head 16. The platen 30 is disposed at a position corresponding to the second print head 29. Printing is performed with respect to the sheet P by the second print head 29 in a state in which the sheet P is supported on the platen 30.

On the downstream side of the second print head 29 and the platen 30 are disposed a sheet discharge roller 31 and a conveyance pulley 32. The conveyance pulley 32 is urged toward the sheet discharge roller 31. The conveyance pulley 32 is urged toward the sheet discharge roller 31 by a spring. The sheet discharge roller 31 is rotatably driven in a state in which the sheet P is nipped between the sheet discharge roller 31 and the conveyance pulley 32, so that the sheet P is conveyed along the conveyance path. The sheet discharge roller 31 is a pulley having teeth formed at the periphery thereof, and further, its surface is made of a material having a small surface energy and containing a fluororesin or the like therein. Consequently, it is possible to suppress occurrence of a smear caused by the sheet discharge roller 31 even if the sheet P immediately after the printing performed by the second print head 29 is brought into contact with the sheet discharge roller 31.

On the downstream side of the sheet discharge roller 31 and the conveyance pulley 32 is disposed a sheet discharge sensor 33 serving as a detecting unit for detecting that the sheet is discharged. The sheet discharge sensor 33 can detect the sheet when the sheet passes a position corresponding thereto. Moreover, on the downstream side of the sheet discharge sensor 33 is disposed the sheet discharge tray 4. The sheet P having discharged after printing is stacked on the sheet discharge tray 4. Since the sheet discharge sensor 33 is disposed on the upstream side of the sheet discharge tray 4, the sheet discharge sensor 33 securely detects the sheet P being conveyed onto the sheet discharge tray 4.

When printing is performed with respect to the sheet P, a sheet P is taken out of the sheets stacked on the sheet supply cassette 3, and then, is conveyed along the conveyance path. When the sheet P is started to be conveyed, the ink jet printing apparatus is switched from a sheet supply standby state to a print state in which a printing operation is performed.

In the sheet supply standby state, the pressure plate 7 is pushed down to a predetermined position by a release cam. Consequently, the sheets stacked on the pressure plate 7 are separated from the sheet supply roller 8, which is not, therefore, brought into contact with the stacked sheets even if it is rotated, so that no sheet is conveyed. During the sheet supply, the release cam is driven, and therefore, the pressure plate 7 is moved from the separated position toward the position in which the sheet supply roller 8 is located. The movement of the pressure plate 7 causes the sheets P stacked on the pressure plate 7 to be moved toward the sheet supply roller 8, which thus abuts against the sheets P stacked on the pressure plate 7. In this state, when the sheet supply roller 8 is rotationally driven, the sheet P is pushed out according to the rotation of the sheet supply roller 8, to be thus picked up on the conveyance path. At this time, only one sheet placed at a position nearest to the conveyance roller out of the stacked sheets P is separated from the other stacked sheets by the separating member 10. And then, only the one sheet separated from the stacked sheets is supplied onto the conveyance path. At this time, the sheet supply roller 8 is designed to have a circumferential length so as to obtain a conveyance amount enough to feed the sheet P between the conveyance roller 14 and the pinch roller 15, described later, by one rotation. Consequently, the sheet supply roller 8 stops after one rotation every time one sheet is supplied, and then, driving force is cut off when the sheet supply roller 8 is separated from the sheets P in the standby state.

Subsequently, the sheet P is conveyed along the conveyance path under the guidance between the upper guide and the lower guide 12. While the sheet P passes between the upper guide 11 and the lower guide 12, the first sheet sensor 13 detects the sheet P.

Next, the sheet P passes a region defined between the conveyance roller 14 and the pinch roller 15, and then, it is conveyed to the first printing unit 5 including the first print head 16. In the first printing unit 5, while the sheet P is conveyed on the platen 17, ink is ejected from the first print head 16 so as to perform printing on the sheet P in a state in which the sheet P is supported on the platen 17. At this time, the ejection timing of the first print head 16 is controlled based on timing when the tip of the sheet P in the conveyance direction is detected by the first sheet sensor 13.

When the sheet P is conveyed to a position facing the first print head 16, the first print head 16 performs a printing operation. During the printing operation, a heater included in the first print head 16 is driven, so that ink is ejected onto the sheet at predetermined timing, thereby performing printing.

The sheet P after being printed by the first print head 16 is conveyed through a region defined between the sheet discharge roller 18 and the conveyance pulley 19. Subsequently, the sheet P is conveyed onto the U-turn path 21. After the sheet P passes above the sheet guide 20, the sheet P is reversed along the U-turn guide 21, and thus, the conveyance orientation is changed. The sheet P is conveyed along the conveyance path by the U-turn conveyance roller pairs 22 and 23 on the U-turn guide 21. The tip of the sheet P reversed during the U-turn conveyance is detected by the second sheet sensor 24 serving as intermediate sheet detecting means for detecting the sheet at an intermediate position on the conveyance path. At this time, the sheet is guided onto the conveyance path by the upper guide 25 and the lower guide 26 while the tip of the sheet is detected. The configuration of the second sheet sensor 24 is similar to that of the first sheet sensor 13.

Here, the ink on the surface (i.e., the obverse) of the sheet after being printed by the first print head 16 may not be fixed according to the kind of sheet or ink application amount. If the contact portion of the sheet sensor is brought into contact with the obverse of the sheet when the ink is not sufficiently fixed, the contact portion drags the ink staying on the obverse of the sheet, thereby raising a possibility of occurrence of a smear which signifies that the printed surface of the sheet is smudged. In view of this, the second sheet sensor 24 is brought into contact with the surface of the sheet, onto which no ink is applied, opposite to the surface printed by the first print head 16, thus preventing occurrence of a smear. Incidentally, the first sheet sensor 13 is brought into contact with the sheet before the start of the printing operation, thereby basically raising no problem of a smear. For this reason, the first sheet sensor 13 and the second sheet sensor 24 do not particularly include any rotating members, as described later, at the tip of an arm (i.e., a lever) that is designed to be brought into contact with the sheet.

After the sheet P passes between the upper guide and the lower guide 26, it is conveyed between the conveyance roller 27 and the pinch roller 28, and thus, it is conveyed to the second printing unit 6. In the second printing unit 6, the second print head 29 performs printing on the sheet P. The configuration of the second print head 29 is similar to that of the first print head 16. In the second printing unit 6, the sheet P is conveyed on the platen 30 while the printing operation is performed on the reverse of the sheet P. At this time, the second print head 29 ejects ink droplets onto the sheet P and performs the printing operation at predetermined timing based on the detection position detected by the second sheet sensor 24. In this manner, the ink ejection timing of the second print head 29 is controlled based on the detection position detected by the second sheet sensor 24.

The sheet P printed by the second print head 29 is conveyed between the sheet discharge roller 31 and the conveyance pulley 32. After the sheet P passes between the sheet discharge roller 31 and the conveyance pulley 32, it passes a position facing the sheet discharge sensor 33, and then, is discharged to and stacked on the sheet discharge tray 4.

While the sheet P passes the position facing the sheet discharge sensor 33, its presence is detected there. Therefore, in a case where the passing of the sheet P is not detected there, it is determined that the sheet cannot reach the sensor position due to the occurrence of a jam of the sheet. In this manner, the sheet discharge sensor 33 can detect the occurrence of a jam of a sheet. Moreover, in a case where a print image shall be charged a fee when a sheet having the print image formed thereon is output, the discharge of the sheet can be certainly detected so that the number of output sheets can be counted with reliability. After the sheet P is discharged onto the sheet discharge tray 4, the printing operation is ended.

Next, explanation will be made on the sheet discharge sensor 33 that is one of the features of the present embodiment. The sheet discharge sensor 33 is provided for detecting the discharge of the printed sheet so as to confirm that the sheet P is reliably discharged from the apparatus. If the sheet discharge sensor 33 cannot confirm the discharge of the sheet after the printing operation on the sheet P, it can be determined that the sheet is jammed somewhere on the conveyance path. At this time, the sheet discharge sensor 33 detects the occurrence of the jam inside of the apparatus. Furthermore, the first sheet sensor 13 and the second sheet sensor 24 can specifically detect where the jam occurs.

Figure 4:
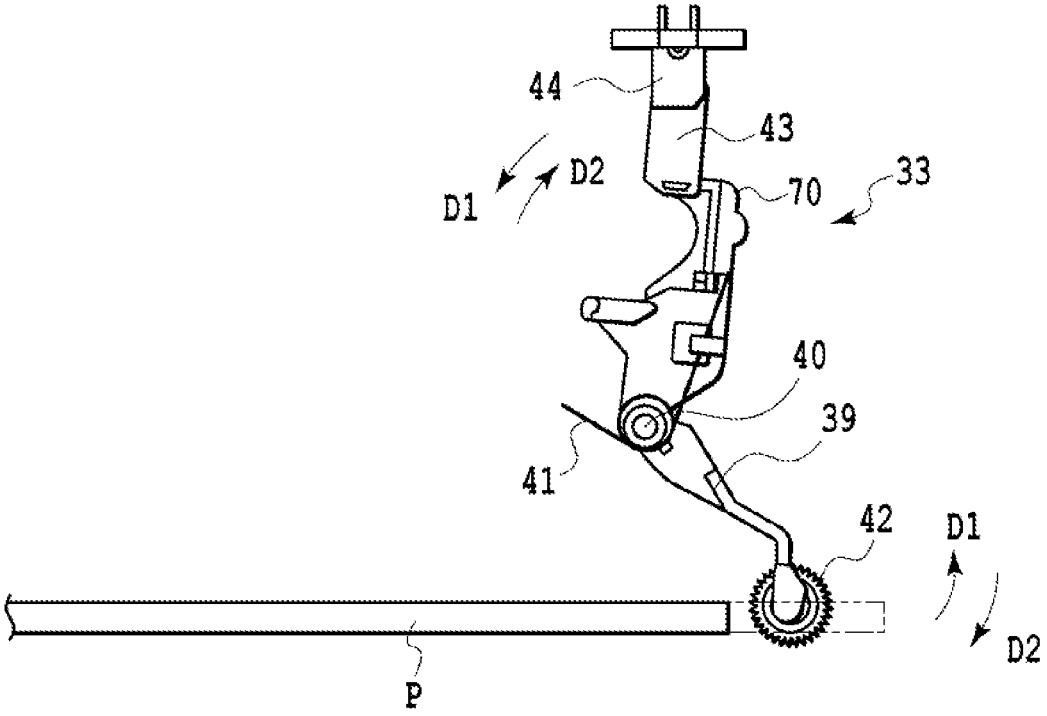
FIG. 4 is a side view showing a sheet discharge sensor in a state in which the sensor does not detect any sheet yet.
Figure 5:
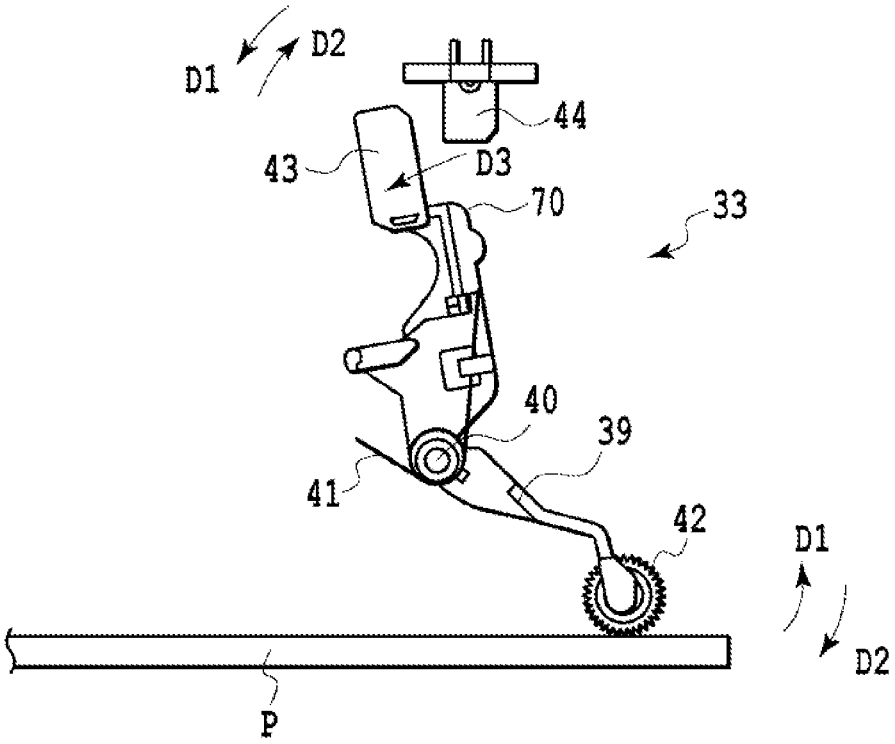
FIG. 5 is a side view showing the sheet discharge sensor in a state in which the sensor detects a sheet.

FIGS. 4 and 5 are side views showing the sheet discharge sensor 33. FIG. 4 is a side view showing a state in which the sheet P has not yet reached the detection position, and FIG. 5 is a side view showing a state in which the sheet P reaches the detection position.

The sheet discharge sensor 33 includes a main unit 70, a detecting arm 39, a flag 43, and a photointerrupter 44. At the tip of the detecting arm 39 is disposed a pulley-shaped rotating member 42, as described later.

The lever-like detecting arm 39 is formed in such a manner as to extend from the main unit 70 toward the sheet detection position. The flag 43 is formed in such a manner as to extend from the main unit 70 toward the photointerrupter 44. The main unit 70, the detecting arm 39, and the flag 43 are formed integrally with each other. Therefore, the detecting arm 39 and the flag 43 are not displaced relatively to the main unit 70, but they are steadily fixed to the main unit 70.

A through hole is formed at the main unit 70. A rotation axis 40 extending from a printing apparatus body is inserted into the through hole. In this manner, the main unit 70, the detecting arm 39, and the flag 43 are such configured as to be freely rotated about the rotation axis 40. The rotation axis 40 is steadily fixed to the printing apparatus body. Consequently, the main unit 70, the detecting arm 39, and the flag 43 can be rotated about the rotation axis 40 without any variation in distance between the rotation axis 40 and the surface of the conveyance path, on which the sheet P is supported and conveyed.

An urging spring 41 (i.e., urging means) is securely wound around the rotation axis 40. One end of the urging spring 41 is connected to the main unit 70. When the main unit 70 is rotated about the rotation axis 40 in directions indicated by arrows D1 in FIG. 4, force acts in such a manner as to rotate the main unit 70 in directions indicated by arrows D2 by the reaction force of the urging spring 41. In other words, even if the force acts in the directions D1 in which the main unit 70, the detecting arm 39, and the flag 43 are rotated, they are urged by the urging spring 41 in the directions D2 in which they are rotated.

The detecting arm 39 can be stopped from being rotated farther in the directions D2 at the surface of the conveyance path, on which the sheet P is conveyed. The detecting arm 39 is kept to be urged by the urging spring toward the conveyance path, on which the sheet P is conveyed. Since the positional relationship between the detecting arm 39 and the rotation axis 40 is determined in the above-described manner, the detecting arm 39 is kept to be urged toward the detection position of the sheet P all the time.

At the tip of the detecting arm 39 is supported the rotatable pulley-shaped rotating member 42. The rotating member 42 is rotationally driven in contact with the sheet to be conveyed.

At the outer periphery of the rotating member 42 is formed a tooth portion 45 consisting of a plurality of teeth, each having a sharp tip.

On the side of the printing apparatus body of the sheet discharge sensor 33 is disposed the photointerrupter 44. An optical axis extending between a light emitting element and a light receiving element in the photointerrupter 44 is oriented in a direction perpendicular to the sheet surfaces of FIGS. 4 and 5. Incidentally, the photointerrupter is merely one example, and therefore, detecting means is not limited to an optical detecting method, but an electric detecting system utilizing a contact of an electrode, as described later, or another detecting system may be used.

The detecting arm 39 is formed in such a manner as to be relatively long. Since the detecting arm 39 is long formed, a light emitter of the light emitting element and a light receiver of the light receiving element in the photointerrupter 44 can be remote from the printed surface, and further, ink mist floating inside of the printing apparatus can be suppressed from adhering to the light emitter and the light receiver. Consequently, it is possible to suppress detection accuracy by the photointerrupter 44 from being degraded caused by the adhesion of the ink mist to the light emitter or the light receiver. The photointerrupter 44 includes a cover member such configured as to surround the light emitting element and the light receiving element with a plastic. In this manner, it is possible to securely suppress the ink mist from adhering to the photointerrupter 44.

As shown in FIG. 4, in a case where no sheet P is located at the detection position, the sheet discharge sensor 33 is positioned on the conveyance path of the sheet P. In this state, the flag 43 fixed to the main unit 70 is located at such a position as to shield between the light emitting element and the light receiving element in the photointerrupter 44. In this state, a light beam emitted from the light emitting element cannot be received by the light receiving element. In a case where a detection level by the light receiving element is LOW, it is determined that no sheet P exists at the detection position.

In the meantime, as shown in FIG. 5, when the sheet P is conveyed to the detection position, the rotating member 42 attached to the tip of the sheet discharge sensor 33 rides on the sheet P, and therefore, the rotating member 42 is elevated, to be thus displaced in the direction D1. According to the displacement of the rotating member 42 in the direction D1, the main unit 70 is rotated about the rotation axis 40 in the direction D1. When the main unit 70 is rotated in the direction D1, the flag 43 is displaced in a direction D3 accordingly. That is to say, the rotating member 42 is brought into contact with the sheet on the conveyance path, on which the sheet is conveyed, and then, the detecting arm 39 is rotated about the rotation axis 40 when the rotating member 42 rides on the sheet while the sheet is kept to be conveyed as it is, so that the angle of the detecting arm 39 is varied. Consequently, the flag 43 is displaced. The displacement of the flag 43 in the direction D3 enables the flag 43 to be separated from the optical axis extending between the light emitting element and the light receiving element in the photointerrupter 44. And then, the output level of the light receiving element becomes HIGH, and therefore, it is determined that the sheet P exists at the detection position.

Since the rotating member 42 is kept to be urged toward the conveyance path, the rotating member 42 is kept to be rotated in contact with the sheet P in association with the conveyance of the sheet P after the rotating member 42 rides on the sheet P. The rotating member 42 is urged toward the conveyance path, and then, the rotating member 42 is brought into contact with the sheet P while the sheet P passes between the rotating member 42 and the surface of the conveyance path.

Figure 6:
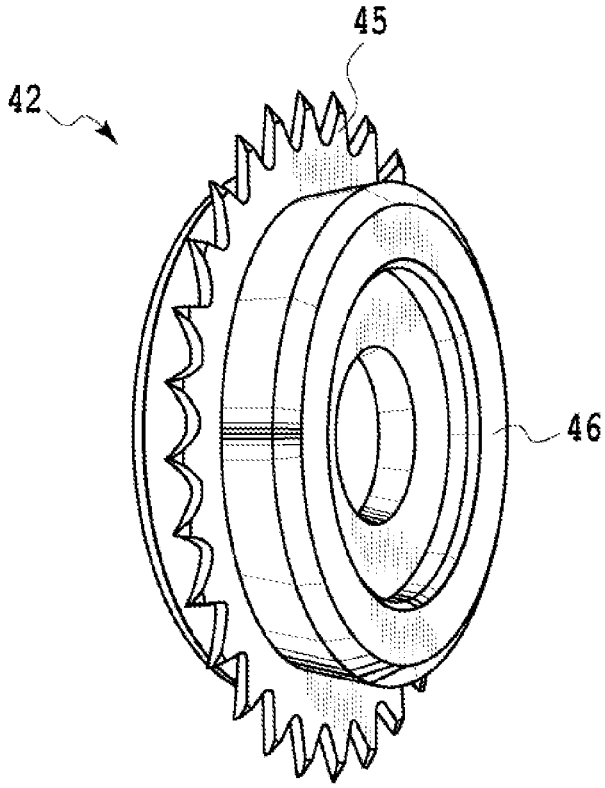
FIG. 6 is a perspective view showing a rotating member (i.e., a pulley) supported by the sheet discharge sensor.

FIG. 6 is a perspective view showing the outside appearance of the structure of the rotating member 42. The rotating member 42 is such configured as to include the tooth portion 45 having the teeth formed at the outer periphery thereof and a bearing 46. In forming a thread of the tooth portion 45, a metal made of a stainless thin plate or the like as an original material is subjected to photoetching, pressing, or the like. Moreover, a joint between the tooth portion 45 and the bearing 46 is formed by outsert molding or the like. At the tooth portion 45 are formed the plurality of teeth over the entire outer periphery in such a manner as to surround the outside of the rotating member 42. The bearing 46 is made of a resin.

Figure 9:
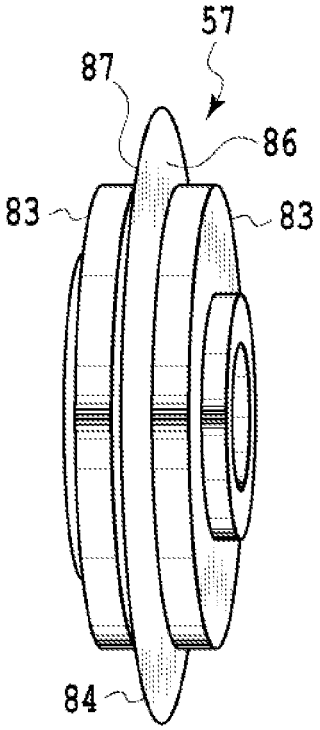
FIG. 9 is a perspective view showing a rotating member (i.e., a disk-like member) for use in the sheet sensor.

The teeth of the tooth portion 45 consist of the thread, each having a sharp tip. The tooth has an acute tip angle, and therefore, an area of a portion in abutment against the sheet P becomes very small. Consequently, even if the sheet having the ink that has not yet dried is brought into contact with the sheet discharge sensor 33, the rotating member 42 is rotationally driven while being smoothly moved on the sheet P at a small contact area. As a consequence, the sheet discharge sensor 33 cannot smudge the image with the ink, thereby suppressing the occurrence of a smear. In addition, even if the ink adhering to the tooth tip of the tooth portion 45 adheres to the sheet again after one rotation of the tooth portion, the area and ink amount due to the re-adhesion are remarkably slight, thereby suppressing image deficiency. Here, it is more desirable to subject at least the tooth tip of the tooth portion 45 to water repellent processing. Incidentally, the rotating member 42 may not have the plurality of teeth, as shown in FIG. 9, described later.

The rotating member 42 of the sheet discharge sensor 33 returns to its original position by the urging force after the sheet P passes the detection position. During the passage of the sheet P through the detection position of the sheet discharge sensor 33, the existence of the sheet P can be kept to be detected. In other words, not only the timing at which the tip of the sheet P reaches the detection position but also the timing at which the rear end of the sheet P passes the detection position can be detected.

Since the size and conveyance speed of the sheet have been already known, a difference in timing when the fore end and rear end of the sheet pass can be estimated. If both of the fore end and rear end of the sheet are detected with an estimated and predetermined difference in timing, it can be determined that the sheet is reliably discharged. If the fore end of the sheet cannot be detected at a preceding sheet discharge timing in spite of the start of the printing operation at the second printing unit, it is determined that the sheet is jammed inside of the apparatus. In this case, the occurrence position of the jam is estimated according to the detection condition of the sheet at the sheet sensor 13 and the sheet sensor 24. In a case where a difference in timing is greater than a predetermined value even though both of the fore end and rear end of the sheet are detected, it is determined that the difference portends a jam at the discharge unit.

Although the sheet discharge sensor 33 is brought into contact with the surface of the sheet printed at the second printing unit 6 in the present embodiment, the sheet discharge sensor 33 may be brought into contact with the surface of the sheet reverse to the surface printed at the second printing unit 6.

As described above, the sheet discharge sensor 33 is provided for confirming the discharge of the sheet after the double-sided printing operation, and therefore, the occurrence of the jam can be detected even if the jam or the like occurs on the sheet anywhere on the conveyance path. At this time, even if the sheet having the wet ink thereon is brought into contact with the sheet discharge sensor 33, the rotating member 42 is rotated, and therefore, the rotating member 42 does not drag the ink, thus suppressing the occurrence of a smear. The rotating member 42 is rotated while its sharp tooth tips are intermittently brought into contact with the sheet. Consequently, there appears only a slightly dotted trace that is hardly visually observed by an observer, thus effectively suppressing the occurrence of a smear such as a linear dragged trace on an image.

In addition, all of the rollers that are brought into contact with the image on the conveyance path after the ink is applied at the printing unit are the pulleys having the plurality of teeth formed at the periphery thereof. Hence, it is possible to effectively suppress a smear such as a linear dragged trace from occurring on an image caused by the contacts between the members and the sheet.

No occurrence of a smear signifies no need of a long drying period of time required for fixing the image on the sheet, thus coping with the sheet conveyance at a higher speed. In view of this, both of the first printing unit and the second printing unit are provided for performing the double-sided printing operation for the purpose of an increase in throughput. Since the apparatus has no complicated reverse path, on which the sheet is turned upside down, the sheet can be conveyed at a high speed. Consequently, the double-sided printing can be performed at a high speed in cooperation with line printing that can be performed by the use of the full-line type ink jet head of a high printing speed. For example, sheets of an A4 size can be subjected to double-sided printing at a rate of 60 PPM (60 pieces of paper per minute) or more.

In the present embodiment, the rotating member is provided in the sheet discharge sensor that is brought into contact with the image surface so as to suppress a smear, and further, the two printing units are used for the obverse and reverse of the sheet so as to increase the printing speed. Thus, it is possible to achieve the printing apparatus capable of printing images of a high quality on both surfaces of the sheet at a very high speed.

Second Exemplary Embodiment

Next, a description will be given of a second embodiment according to the present invention. Explanation on constituent elements similar to those in the first embodiment will be omitted, and therefore, the description will center on different constituent elements.

Figure 7:
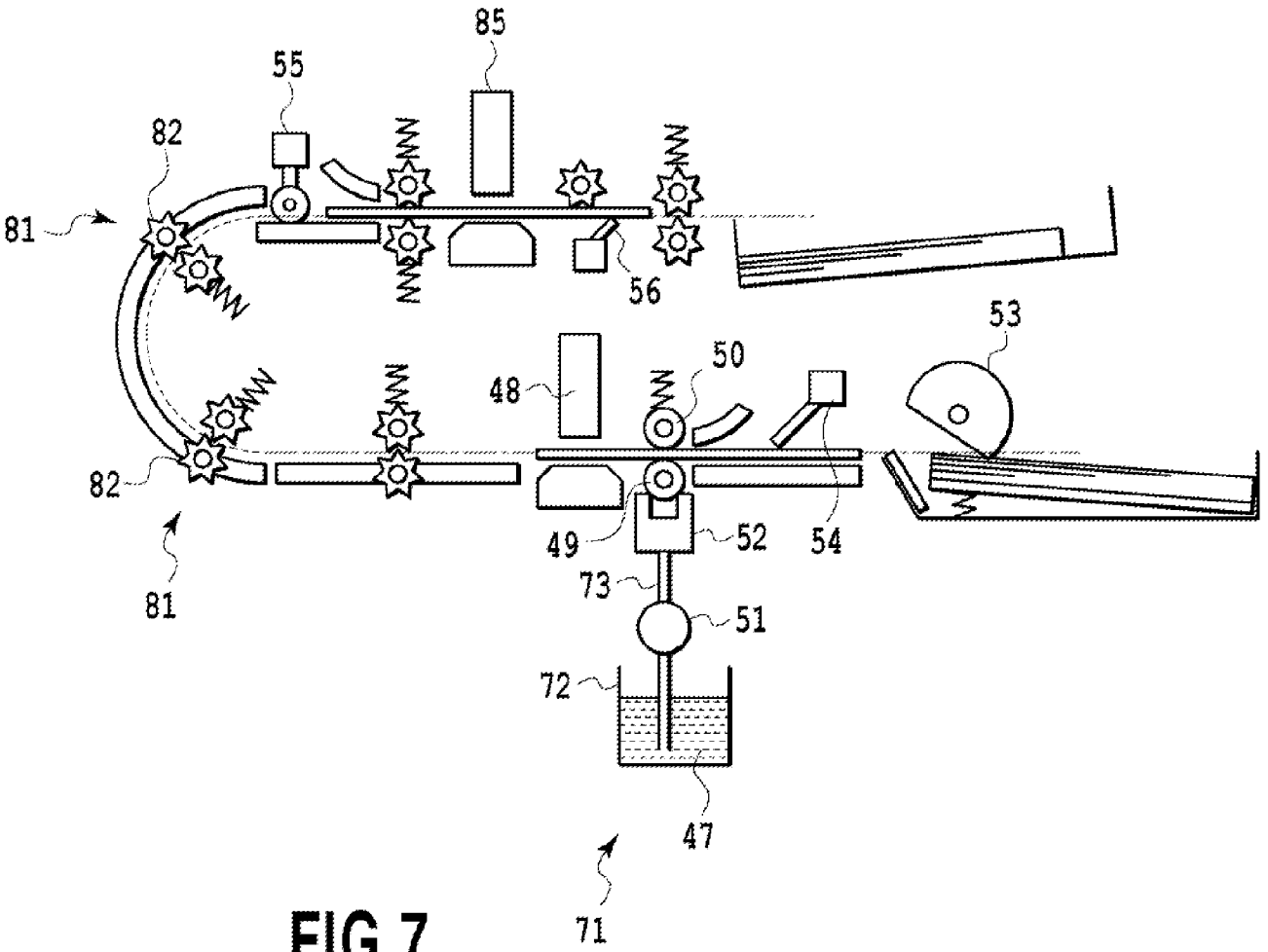
FIG. 7 is a cross-sectional view schematically showing a sheet conveyance path in an ink jet printing apparatus according to a second embodiment of the present invention.

FIG. 7 is a cross-sectional view schematically showing a sheet conveyance path in an ink jet printing apparatus in a second exemplary embodiment. In the present embodiment, an application liquid 47 is applied onto a print surface of a sheet, on which printing is performed, prior to printing with ink droplets.

The application liquid 47 is mixed, on a sheet, with ink containing a pigment as a colorant, thereby quickening coagulation of the pigment contained in the ink. Therefore, the application liquid 47 is applied onto the sheet prior to printing, thereby quickening the coagulation of the ink to be ejected onto the sheet thereafter, so as to suppress the occurrence of a smear thereafter, and thus, enhance the quality of a print image.

A clear, colorless application liquid is generally used. At this time, if the application liquid is unevenly applied, an image printed with the ink may be possibly uneven according to the unevenness of the application liquid. Therefore, a smear occurs during the application of the application liquid, possibly resulting in degradation of a quality of a print image. In view of this, a smear needs to be prevented in advance during the application of the application liquid. The components of the application liquid are exemplified as follows:

| | |
|---|---|
| Calcium nitrate tetrahydrate | 10% |
| Glycerin | 42% |
| Surfactant | 1% |
| Water | Balance |

Here, application liquid is not limited to the application liquid capable of quickening the coagulation of the ink pigment component that is mixed with the ink. The present invention can be implemented in an application liquid equipped with other functions such as an application liquid containing components for insolubilizing or coagulating a dye contained in ink after mixing with the ink, or the like.

There is provided an applying unit 71 for applying an application liquid onto a sheet. Here, although the applying unit, described below, is operated in a mode in which a transfer roller is used, this is merely one example. For example, ejecting means similar to an ink jet head for printing may eject and apply an application liquid onto a sheet.

The applying unit 71 includes an application liquid tank 72 for reserving the application liquid 47 therein and a pair of transfer rollers 49 and 50 for applying, onto the sheet, the application liquid 47 reserved in the application liquid tank 72. Moreover, the applying unit 71 includes an application cap 52 for supplying the application liquid to the transfer roller 49 and the transfer roller 50 and a passage 73, on which the application liquid 47 is supplied from the application liquid tank 72 to the application cap 52. Additionally, the applying unit 71 includes a pump 51 to be driven in order to supply the application liquid 47 from the application liquid tank 72 to the application cap 52 through the passage 73.

The application of the application liquid 47 onto the sheet is performed by transfer from the pair of rollers. Here, the transfer roller 49 on a drive side and the transfer roller 50 on a driven side perform the application onto the sheet. At this time, before the transfer roller 49 and the transfer roller 50 perform the application onto the sheet, it is desirable that the application liquid 47 should be sufficiently applied onto both of the transfer roller 49 and the transfer roller 50. Therefore, before the sheet is supplied from a sheet supply cassette 3, to be conveyed between the transfer roller 49 and the transfer roller 50, the following preparing operation is performed.

In order to apply the application liquid 47 to the outer peripheral surfaces of the transfer roller 49 and the transfer roller 50, the pump 51 is driven, so as to feed the application liquid 47 into the application cap 52. As the pump 51 is used a tube pump in order to miniaturize the ink jet printing apparatus. Incidentally, other types of pumps may be used as the pump 51.

The application cap 52 abuts against the transfer roller 49 in such a manner as to surround a part of the peripheral cylindrical surface of the transfer roller 49. Therefore, when the transfer roller 49 is rotated in a state in which the application liquid 47 is reserved in the application cap 52, the application liquid reserved in the application cap 52 adheres to the peripheral cylindrical surface of the transfer roller 49. At this time, the transfer roller 49 is rotated in contact with the application cap 52. Consequently, the contact portion of the application cap 52 with the transfer roller should be desirably made of a fluorine rubber or the like having a small friction resistance with respect to the transfer roller 49.

When no sheet P exists between the transfer roller 49 and the transfer roller 50, the transfer roller 49 is rotationally driven in a state in which the transfer roller 49 is brought into contact with the transfer roller 50. The transfer roller 50 is rotationally driven with the rotational drive of the transfer roller 49. When the transfer roller 49 and the transfer roller 50 are rotated in contact with each other, a part of the application liquid 47 applied onto the transfer roller 49 is applied to the surface of the transfer roller 50. The transfer roller 50 holds a large amount of application liquid 47 applied by the transfer roller 49, and therefore, the transfer roller 50 should be preferably made of a porous material or the like.

When the preparing operation is performed, the transfer roller 49 rotationally drives for only a predetermined period of time by a drive source such as a motor. With this operation, the application liquid 47 is applied to the entire peripheral cylindrical surface of the transfer roller 49, and further, to the entire peripheral cylindrical surface of the transfer roller 50 that is rotationally driven. The application amount of application liquid 47 when the application liquid 47 is applied onto the sheet P is controlled based on the surface roughness of a contact surface between the application cap 52 and the transfer roller 49, an abutment pressure, or the like.

Upon completion of the above-described preparing operation, actual application and printing are started. The tip of the sheet P supplied from a sheet supply roller 53 is detected by a first sheet sensor 54. At this time, since the sheet P is dry without any problem of dragging, and therefore, the ink jet printing apparatus does not include configuration that a rotating member, as described later, is supported at the tip of a detecting arm for the sensor. The first sheet sensor 54 has the same configuration as those of the first sheet sensor 13 and the second sheet sensor 24 in the first embodiment. In the first sheet sensor 54, a contact portion in the sensor for detecting the sheet may be brought into contact with either surface of the sheet.

Subsequently, the transfer roller pair 49 and 50 uniformly applies the application liquid 47 over the entire surfaces of both surfaces of the sheet. When the transfer roller pair 49 and 50 applies the application liquid 47 onto the sheet P, the sheet P is conveyed between the transfer roller 49 that rotationally drives and the transfer roller 50 that rotationally driven while the application liquid 47 is applied onto the sheet P. When the sheet P exists between the transfer roller 49 and the transfer roller 50, the transfer roller 49 rotationally drives in a state in which the sheet P is held between the transfer roller 49 and the transfer roller 50. The rotational driving of the transfer roller 49 enables the sheet P to be conveyed forward in the conveyance direction. At this time, the transfer roller 50 is brought into contact with the sheet P. Therefore, the sheet P is conveyed forward in the conveyance direction, and further, the transfer roller 50 is rotationally driven.

Next, a first print head 48 performs printing on the sheet. At this time, the application liquid 47 has been already applied onto both surfaces of the sheet. Therefore, ink droplets that are ejected onto the sheet and landed are mixed with the application liquid 47 that has been already applied onto the sheet, thereby quickening coagulation of the pigment contained in the ink.

The application liquid 47 contains glycerin having a relatively high hygroscopicity as a component. Therefore, the sheet having the application liquid 47 applied thereonto requires a period of time of several seconds or longer to be sufficiently dried in normal room environment. However, in an ink jet printing apparatus that copes with high-speed printing such as 60 sheets being printed per minute, the sheet P is conveyed at a relatively high speed. Consequently, at timing when the sheet P reaches a second sheet sensor 55, the application liquid is possibly still wet at both of an obverse and a reverse.

As a consequence, a pulley 82 having teeth formed at the periphery thereof is disposed on a downstream side of the first print head 48 and is included in a conveyance roller 81 constituting a conveyance path to the second sheet sensor 55. As shown in FIG. 6, the pulley 82 is a rotating member that includes a tooth portion having a plurality of teeth formed at the periphery thereof and has a remarkably small area of contact with the sheet. In this manner, the application liquid is uniformly applied onto both surfaces of the sheet or the ink applied by the first print head 48 can be suppressed from being dragged by the conveyance roller 81, thereby suppressing occurrence of unevenness.

On the downstream side of the conveyance roller and the pulley 82 in the conveyance direction is disposed the second sheet sensor 55. When the second sheet sensor 55 detects the sheet P, a detecting unit in the sensor is brought into contact with the sheet P having the application liquid 47 applied thereonto. It is necessary to avoid the application liquid from being dragged due to the contact and a smear from occurring on an application layer having the application liquid applied thereonto. In order to suppress the dragging, a rotating member is supported at the tip of a detecting arm of the second sheet sensor 55.

Figure 8:
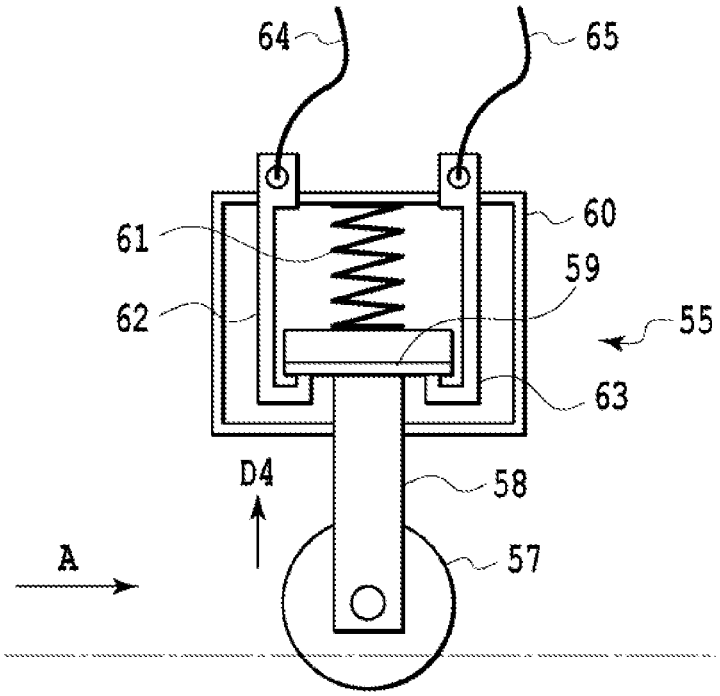
FIG. 8 is a cross-sectional view schematically showing a sheet sensor.

As shown in FIG. 8, the second sheet sensor 55 is provided with a housing 60, a detecting arm 58, and a rotating member 57. At the tip end of the detecting arm 58 is supported the disk-shaped rotating member 57.

The housing 60 is fixed onto the body side of the printing apparatus. Since the housing 60 is fixed onto the body side of the printing apparatus, the distance between the housing 60 and the surface of the conveyance path, on which the sheet P is conveyed, is not varied. The detecting arm 58 is a slider such configured as to be slidably moved in a direction in which the detecting arm 58 is moved close to or apart from the housing 60 relative to a position at which the sheet is conveyed. At the tip of the detecting arm 58 is fixed the rotating member 57 in a rotatably pivoted manner.

The detecting arm 58 is disposed in the housing 60 via a compression spring 61. The compression spring 61 is housed inside of the housing 60, which is fixed to the detecting arm 58 and fixed to inside of the housing 60, in a compressed state. The disk-like rotating member 57 is urged toward the sheet.

To the housing 60 are connected two electrodes (i.e., sensors) 62 and 63. The two electrodes 62 and 63 are secured to the housing 60 at an interval defined therebetween. One end of each of the two electrodes 62 and 63 is bent into a U shape, and further, the other end of each of the two electrodes 62 and 63 is securely fixed to the housing 60. One end of the detecting arm 58, housed inside of the housing 60, is formed into a T shape. The detecting arm 58 is arranged such that a part of one end of the detecting arm 58 formed into the T shape is stretched across the two electrodes 62 and 63 inside of the housing 60. A conducting member (i.e., a conductor) 59 is disposed at a portion of the detecting arm 58 stretched across the two electrodes 62 and 63. The conducting member 59 is connected to both of the tip of the U-shaped end of the first electrode 62 and the tip of the U-shaped end of the second electrode 63.

FIG. 9 is an enlarged perspective view showing the rotating member 57. The rotating member 57 is a disk-shaped structure including bearings 83 and an abutting member 84 projected outward from the bearings 83 in a radial direction. The rotating member 57 is not equipped with teeth at the outer periphery thereof, unlike FIG. 3, but is formed into a disk shape. The abutting member 84 is located in such a manner as to be held between the two bearings 83. Moreover, the thickness of the abutting member 84 is greatest at its portion held between the bearings 83 in an axial direction, and then, the thickness is decrease with the distance from the bearings 83 is increase outward. Two side surfaces 86 and 87 constituting the abutting member 84 are formed into a conical shape. The side surfaces 86 and 87, each having the conical shape, cross each other at the center in the axial direction of the abutting member 84. The side surfaces 86 and 87 constituting the abutting member 84 cross each other at the outside end in the radial direction of the abutting member 84, and form an acute angle. In other words, the abutting member 84 is formed into a shape like "a counter of an abacus." Incidentally, the rotating member 57 may have the structure described with reference to FIG. 6.

The rotating member 57 is made of a material containing a fluororesin, and further, the abutting member 84 in contact with the sheet P also is made of a material containing a fluororesin. Since a resin containing fluorine has a small surface energy, the application liquid hardly adheres to the rotating member 57. Additionally, the portion in contact with the sheet P, of the abutting member 84 is small in thickness and is formed into a shape like a sharp, round blade, and therefore, the portion in contact with the sheet P is small. As a consequence, when the second sheet sensor 55 detects the sheet, the amount of application liquid adhering to the tip of the abutting member 84 is small. The amount of application liquid that adheres to the abutting member 84, and adheres to the sheet again when the rotating member is rotated once, and then, is brought into contact with the sheet P, is very small. In this manner, the application liquid uniformly applied onto the sheet can be suppressed from being dragged by the sensor so as to be unevenly applied.

Next, explanation will be made on the detection of the sheet P by the second sheet sensor 55. As shown in FIG. 8, when no sheet P exists at the detection position by the second sheet sensor 55, the detecting arm 58 is not displaced, and thus, the conducting member 59 is kept to be connected to the first electrode 62 and the second electrode 63. When the detecting arm 58 is brought into contact with the two electrodes 62 and 63 and connected therebetween inside of the housing 60, the respective tips of the U-shaped one ends of the two electrodes 62 and 63 are electrically connected to each other. At this time, lead wires 64 and 65 connected to the electrodes 62 and 63, respectively, are electrically conducted, so that the contact of the detecting arm 58 with each of the two electrodes 62 and 63 is detected. That is to say, the detecting arm 58 is not displaced in a direction close to or apart from the sheet. Thus, it is determined that no sheet exists there.

Figure 10:
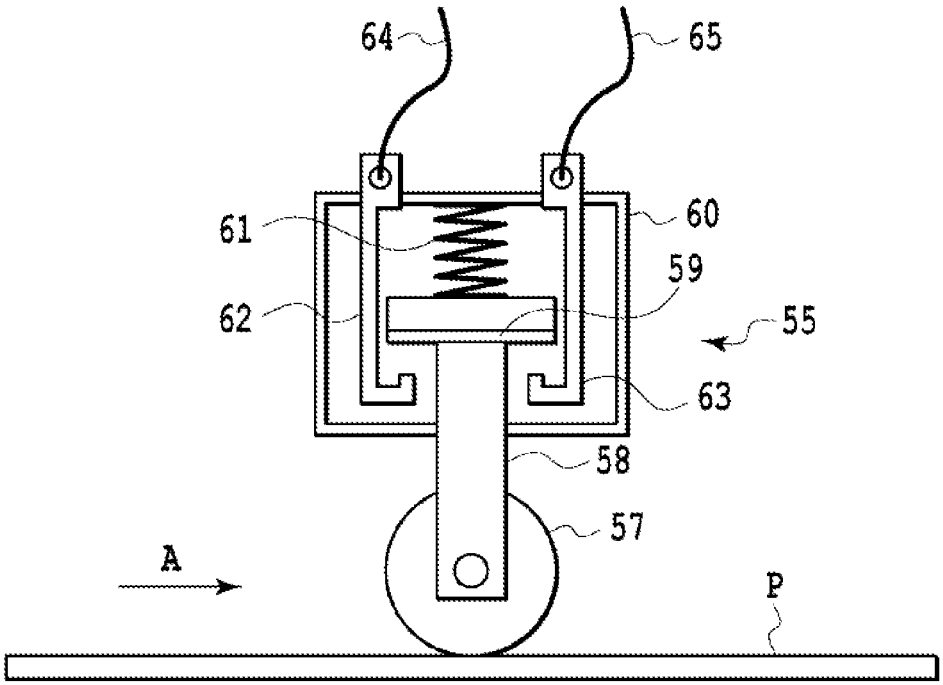
FIG. 10 is a cross-sectional view schematically showing the sheet sensor in a state in which the sheet sensor detects a sheet.

On the other hand, as shown in FIG. 10, when the sheet P is conveyed at the detection position by the second sheet sensor 55, the rotating member 57 in the second sheet sensor 55 rides on the sheet P. At this time, the second sheet sensor 55 rides on the sheet, so that the detecting arm 58 is displaced in a direction D4 apart from the sheet. In this manner, the abutting member 84 in the rotating member 57 is brought into contact with the sheet on the conveyance path, on which the sheet is conveyed. The sheet is continued to be conveyed as it is, and thus, the detecting arm 58 is displaced when the abutting member 84 rides on the sheet. Since the housing 60 is securely fixed onto the printing apparatus body side, the distance between the housing 60 and the surface of the conveyance path on which the sheet P is conveyed is not varied. When the detecting arm 58 is displaced in the direction D4, the detecting arm 58 is displaced while the housing 60 is fixed, and therefore, the electric conduction between the detecting arm 58 and the two electrodes 62 and 63 is shut off. Consequently, no current flows between the lead wires 64 and 65. In a case where no current conduction between the two electrodes 62 and 63 is detected when the current is applied therebetween, it is determined that the detecting arm 58 rides on the sheet, that is, it is displaced. Thus, it is determined that the sheet exists at the detection position by the detecting arm 58.

Upon completion of the detection by the second sheet sensor 55, the second print head 85 performs a printing operation. At this time, the ejection timing of the second print head 85 is controlled while the printing operation is performed based on the timing at which the tip of the sheet P in the conveyance direction is detected by the second sheet sensor 55. The surface reverse to that of the sheet printed by the first print head 48 is subjected to printing operation during the printing operation by the second print head 85.

The discharge of the printed sheet P is detected by the sheet discharge sensor 56. At this time, the ink may not yet be sufficiently fixed onto the surface printed by the second print head 85. In contrast, relatively long time elapses after the printing by the first print head 48, and therefore, the ink is considerably dried. In view of this, the contact portion of the sheet discharge sensor 56 is designed to be brought into contact with the surface printed by the first print head 48. Here, if the sheet discharge sensor 56 includes a rotating member, like the first embodiment, the sheet discharge sensor 56 may detect either surface of the sheet.

As described above, the sheet sensor 55, which is brought into contact with the sheet after the application liquid is applied in the applying unit 71, is provided with the rotating member, thereby suppressing unevenness or a flaw on an applied layer, so as to print an image of a high quality. Moreover, all of the rollers that are brought, on the conveyance path, into contact with the sheet having the image after the application liquid is applied in the applying unit 71 are the pulleys, each having the plurality of teeth formed at the outer periphery thereof. Thus, it is possible to effectively suppress the occurrence of a smear such as a linear dragged trace on the applied layer or the image caused by the contact between the members.

In this manner, the present embodiments are adapted to provide the rotating member for the sensor that is brought into contact with the sheet so as to suppress a smear, and further, provide the two printing units for the obverse and reverse of the sheet, respectively, so as to increase a printing speed. Thus, it is possible to achieve the printing apparatus capable of printing the images of a high quality on both surfaces of the sheet at a high speed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-011166, filed Jan. 24, 2013, which is hereby incorporated by reference herein in its entirety.

What is claimed is:

1. A printing apparatus comprising:

a first printing unit configured to perform printing on a first surface of a sheet by an ink jet system;

a second printing unit configured to perform printing on a second surface of the sheet by the ink jet system, the second printing unit being disposed on a downstream side of the first printing unit; and a detecting unit configured to detect the sheet to be discharged through the second printing unit, wherein the detecting unit includes an arm having a rotating member supported thereon, the rotating member being brought into contact with the sheet being conveyed while being rotated, and the detecting unit detects a displacement of the arm caused by ride of the rotating member on the sheet.

2. The printing apparatus according to claim 1, wherein the rotating member has a plurality of teeth formed at the outer periphery thereof or is made of a material containing a fluororesin.

3. The printing apparatus according to claim 1, further comprising: a roller pair configured to convey the sheet, wherein a roller that is brought into contact with the printed surface of the sheet is a pulley having a plurality of teeth formed at the outer periphery thereof.

4. The printing apparatus according to claim 1, wherein the detecting unit includes a photointerrupter or an electrode configured to detect the displacement of the arm.

5. The printing apparatus according to claim 1, wherein an ink jet head having ink nozzles formed over a range covering the width of a sheet to be used performs printing.

6. A printing apparatus comprising:

an applying unit configured to apply an application liquid onto a sheet;

a printing unit configured to perform printing on the sheet, onto which the application liquid is applied, by an ink jet system, the printing unit being disposed on a downstream side of the applying unit; and a detecting unit configured to detect the sheet, onto which the application liquid is applied, wherein the detecting unit includes an arm having a rotating member supported thereon, the rotating member being brought into contact with a surface, onto which the application liquid is applied, of the sheet being conveyed while being rotated, and the detecting unit detects a displacement of the arm caused by ride of the rotating member on the sheet.

7. The printing apparatus according to claim 6, wherein the rotating member has a plurality of teeth formed at the outer periphery thereof or is made of a material containing a fluororesin.

8. The printing apparatus according to claim 6, further comprising: a roller pair configured to convey the sheet, wherein a roller that is brought into contact with the surface, onto which the application liquid is applied in the applying unit, of the sheet is a pulley having a plurality of teeth formed at the outer periphery thereof.

9. The printing apparatus according to claim 6, wherein the detecting unit includes a photointerrupter or an electrode configured to detect the displacement of the arm.

10. The printing apparatus according to claim 6, wherein an ink jet head having ink nozzles formed over a range covering the width of a sheet to be used performs printing.

* * * * *